United States Patent [19]

McCallum et al.

[11] 4,233,955

[45] Nov. 18, 1980

[54] FIREPLACE AND ROOM HEATER

[76] Inventors: Gerald McCallum, Box 6083 Hillyard Stn., Spokane, Wash. 99207; Dale A. McCallum, S. 402 McKinnon, Spokane, Wash. 99206

[21] Appl. No.: 950,139

[22] Filed: Oct. 10, 1978

[51] Int. Cl.[3] ..... F24C 1/14; F24B 3/00

[52] U.S. Cl. ..... 126/61; 126/63; 126/66; 126/67

[58] Field of Search ..... 126/61, 63, 66, 67, 126/68, 110 R

[56] References Cited

U.S. PATENT DOCUMENTS

| | | | |
|---|---|---|---|
| 3,952,721 | 4/1976 | Patterson | 126/63 |
| 4,128,094 | 12/1978 | Lewis | 126/61 |
| 4,140,101 | 2/1979 | Glover | 126/61 |

*Primary Examiner*—Samuel Scott
*Assistant Examiner*—Wesley S. Ratliff, Jr.
*Attorney, Agent, or Firm*—Wells, St. John & Roberts

[57] ABSTRACT

A fireplace and room heater that makes use of both natural air convection and forced air principles to efficiently heat an adjacent room. The fireplace and heater is freestanding and includes a firebox that is enclosed on three sides by a shell. The shell forms an air space between its walls and the firebox that is used for passage of air. A bulkhead separates the space into two distinct plenum chambers, an upper chamber and a lower chamber. A blower is provided at the rear of the unit. An intake of the blower opens into the lower plenum chamber. A discharge of the blower opens into the upper plenum chamber. Air is drawn through the lower plenum chamber by the blower and is forced outwardly through the upper plenum chamber through the blower discharge. The blower is controlled by a rheostat and thermostat to facilitate selective adjustment of air flow through the unit.

6 Claims, 6 Drawing Figures

FIREPLACE AND ROOM HEATER

BACKGROUND OF THE INVENTION

The present invention relates in general to space heating equipment and more particularly to free standing, wood burning units that may be utilized both as fireplaces and as room heaters.

Current trends in energy conservation have led to the design of freestanding fireplace and heater units that are significantly more efficient than the permanent masonry fireplace structure. Most such freestanding structures, however, remain relatively inefficient for the amount of fuel consumed. This is primarily because the number of surfaces heated by the fire contained within the partially enclosed fireboxes are not exposed to cooling air. Therefore heat is not efficiently exchanged with the air in the adjacent room.

It is fairly typical to provide some form of forced air unit in conjunction with a freestanding heating unit that will force cooling air across one or more of the heated surfaces of an associated firebox. The bottom surface is typically heated along with the other surfaces of the firebox but is usually not effectively utilized for heat exchange purposes. Furthermore, the typical form of freestanding fireplace and heating unit that does provide some form of forced air feature usually includes an exposed blower adjacent its forward side. Such blowers typically pull the air from the area directly adjacent the unit to blow it across the heated firebox surfaces. It is usually necessary for the blower to be spaced adjacent to the firebox so it is not at all unusual for the heated air to be pulled back through the intake of the blower unit. This decreases heating efficiency by reheating or maintaining the heat of the previously heated air without spreading it throughout the adjacent room area.

It therefore becomes desirable to obtain some form of freestanding fireplace and heater combination that will make effective use of heated firebox surfaces plus the principles of convection and forced air to provide an efficient heat exchanging unit.

It is also desirable to obtain a combined fireplace and heating unit wherein a forced air blower is supplied that is not visible from the front of the unit.

DETAILED DESCRIPTION OF A PREFERRED EMBODIMENT

Figure 1:
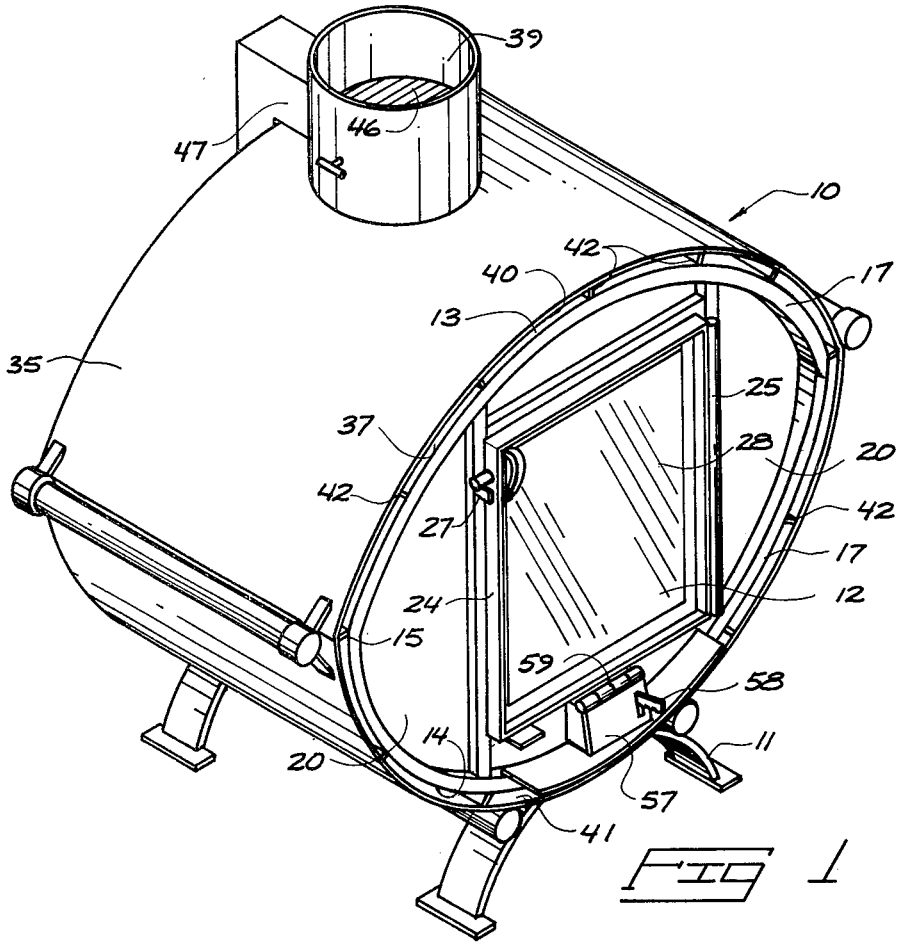
FIG. 1 is a pictorial view of the present invention.

The present fireplace and room heater is indicated in the accompanying drawings by the reference character 10. Hereafter, for the sake of brevity, the fireplace and room heater will be simply termed "heater". The present heater 10 is mounted on upwardly arched supporting legs 11 to space an enclosed firebox 12 elevationally from any supporting surface.

Figure 2:
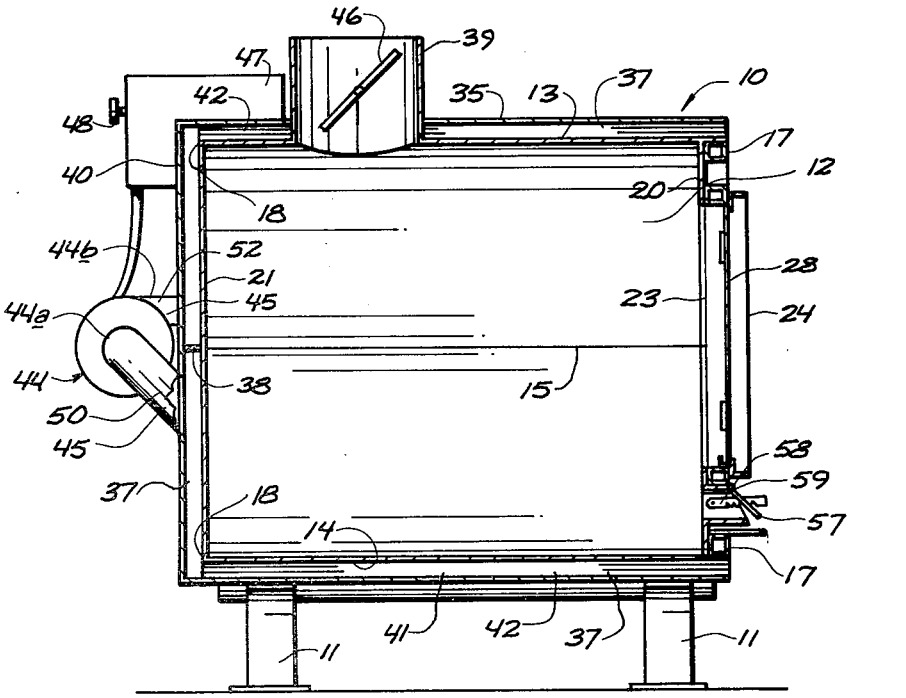
FIG. 2 is a sectional view taken along line 2—2 in FIG. 1.

The firebox 12 is defined by four interconnected surfaces. An arcuate top surface 13 is provided that is joined at end edges 15 to a bottom arcuate surface 14. The top and bottom surfaces 13 and 14 are biconvex to produce the lens or "cat's eye" configuration of the heater both for the purpose of aesthetics and utility as will be discussed later. The surfaces 13 and 14 are generally rectangular, being joined at their end edges 15. They also include vertically aligned forward side edges 17 and parallel rearwardly spaced rear side edges 18 (FIG. 2). An upright front wall 20 extends between the forward side edges 17 and an upright back wall 21 extends between the rear side edges 18.

A rectangular access opening is formed through the upright front wall 20 to allow access to the firebox interior. A door 24 is mounted by a hinge 25 to the upright front wall 20. The door enables selective closure of the access opening 23 (FIG. 2) to prevent passage of excessive combustion air to a fire contained within firebox 12.

Figure 5:
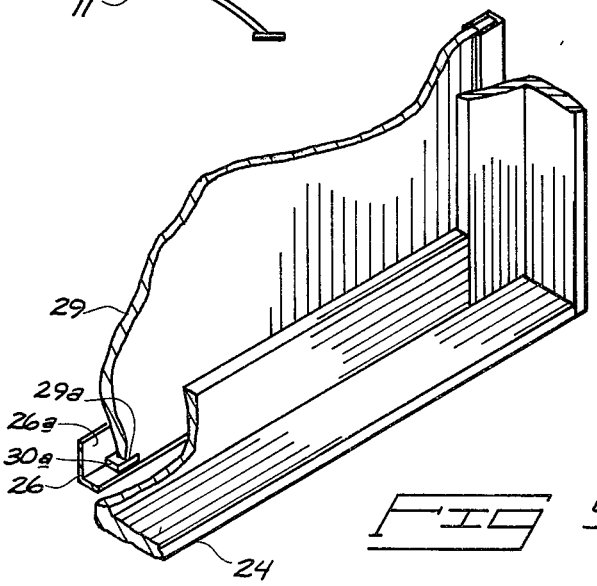
FIG. 5 is a fragmentary sectioned view of the door structure for the present invention incorporating a removable metal plate insert.

The door 24 includes a rectangular frame 26 that mounts a manually releasable latch 27. Also supported by the frame 26 is a pane of glass 28. The glass 28 allows viewing of a fire within the firebox 12 while partially covering the access opening to free passage of combustion air. Glass 28 is removable from the frame 26 and may be replaced with a metal plate 29 (FIG. 5). The metal plate 29 is utilized primarily when the unit is functioning entirely as a heating unit rather than a fireplace. The plate 29 provides a more complete seal and has structural properties that cannot be offered even by tempered glass. It thus provides security for extended, overnight heating periods.

Figure 6:
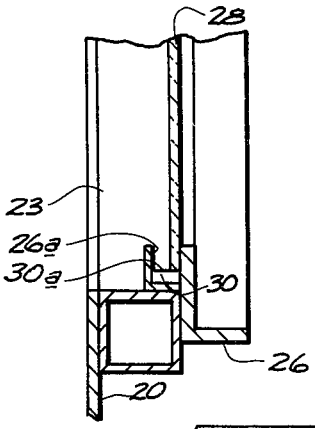
FIG. 6 is a fragmentary sectioned view of the door structure taken along line 6—6 in FIG. 3.

FIG. 6 shows the glass 28 in place within the door frame and spaced slightly from the frame to define an airspace 30. The bottom edge of the glass pane 28 rests on bosses **30*a* that are formed along the door frame bottom. The resulting airspace 30 between the door frame 26 and glass 28 is used to allow cleansing air to enter for cooling and preventing soot from forming on the inside surface of the glass. Air is drawn into the firebox area through opening 30 and is directed by a lip 26*a* of frame 26 upwardly over the inside glass surface. This cools the glass and prevents soot buildup that would normally obstruct a clear view of the fire. The plate 29, being opaque, doesn't require the airspace and is accordingly notched at 29*a*** to provide a substantially airtight fit with the door frame.

An important feature of the present invention is provision of a shell 35 around the surfaces 13, 14 and back wall 21. Shell 35 thus encompasses the firebox with the exception of the upright front wall 20. The shell 35 is formed of metal sheet or plate material similar to surfaces 13, 14 and walls 20, 21 except that it may be of a slightly lighter gauge. A space 37 is defined between the shell 35 and the surfaces 13, 14 and wall 21. This space 37 is substantially equal or uniform about the adjacent firebox surfaces. Air is received and discharged through space 37 at a forward opening 36 located adjacent front wall 20.

Uniformity of space between the firebox 12 and shell 35 is maintained by a plurality of rib members 42. The rib members 42 extend from the opening 36 rearwardly to the rear side edges 18 of the top and bottom surfaces. Another function of rib members 42 is to transfer heat by conduction to the shell 35. Thus, air will be passed across heated surfaces on all sides of the space 37.

A bulkhead 38 interconnects the shell 35 with the firebox 12. Bulkhead 38 extends from the junction of end edges 15 outwardly to a similar junction along the sides of the shell 35. It also extends horizontally across the upright back wall 21 and the adjacent portion of the shell 35. Thus, bulkhead 38 substantially horizontally bisects the space 37 and defines two individual plenum chambers between the bulkhead 38, shell 35, and firebox 12. An upper plenum chamber is designated at 40, and a lower plenum chamber at 41. The lower plenum chamber extends across the bottom surface 14 and approximately half way up the upright back wall 21 while the upper chamber 40 extends across the top surface 13 and approximately half way down the back wall 21. Bulkhead 38 seals chamber 40 from 41.

Figure 3:
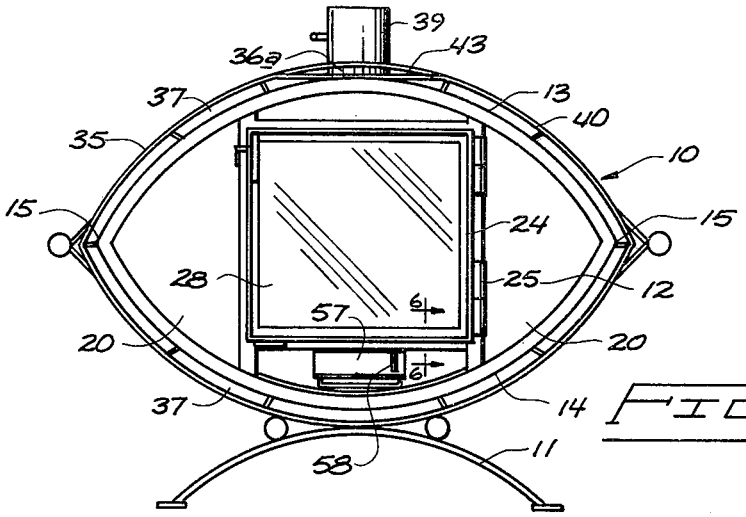
FIG. 3 is a frontal elevation of the present invention incorporating a cooking surface.

FIG. 3 illustrates a slightly altered version of the shells and firebox 12 to provide for a horizontal cooking surface 43. The surface 43 may be formed substantially integrally with the shell 35 to come into close proximity or actual contact with the top surface 13. With this provision a portion 36*a* of the opening 36 is located rearwardly of the forward side edges 17 but functions primarily the same. Surface 43 may be utilized for cooking purposes, thus adding to the utility of the entire unit.

It is necessary to place the cooking surface 43 in close proximity or in actual contact with the firebox 12 in order that sufficient heat may be conducted to the surface 43. Otherwise, the heat exchange function of the firebox and shell assembly is such that no cooking may be accomplished at the elevation of the upper surface of shell 35.

A flue 39 and associated opening are situated in open contact with the firebox interior and lead upwardly and outwardly therefrom. The flue 39 is specifically located adjacent to the back wall 21 and may open partially through that wall and the top surface 13 or may open entirely through the top surface 13 as shown in the drawings. The flue 39 may include an appropriate damper plate 46 that may be selectively adjusted to determine the amount of "draw" produced through an associated chimney (not shown).

Figure 4:
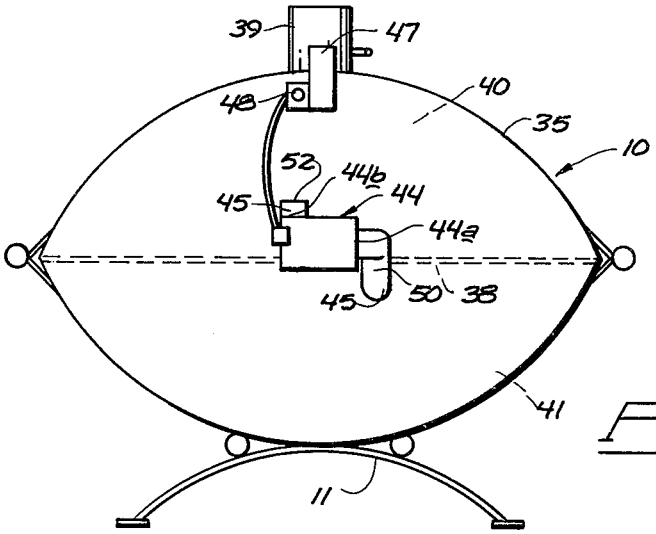
FIG. 4 is a rear elevational view.

Another very important feature of my invention is provision of a blower means 44 as shown specifically in FIGS. 2 and 4. The blower means 44 is operable to receive air through an intake 44*a* and forceably discharge the same air through a discharge 44*b*. Blower means 44 may be comprised of a conventional "squirrel cage" blower wherein the openings 44*a* and 44*b* are at substantially right angles. However, other forms of existing blowers may also be effectively utilized including those with coaxial intake and discharge openings.

In the preferred form a duct means 45 is provided to connect the blower with the plenum chambers 40, 41. Duct means 45 may include an intake section 50 extending between the lower plenum chamber 41 and the blower intake 44*a*, and a discharge section 52 extending between the blower discharge 44*b* and the upper plenum chamber 40. It may be understood that operation of the blower will produce an air current through the space 37 with air being drawn into the lower plenum 41 and forced outwardly through the upper plenum 40.

The ducts formed through the shell 35 adjacent upright back wall 21 are situated closely adjacent to the bulkhead 38. Specifically the opening for the intake section 50 of the duct means 45 is directly below the bulkhead 38 while the opening for the discharge section 52 is situated immediately above the bulkhead 38. This positioning of the ducts and openings encourages natural convection of air through both plenum chambers 40 and 41. Cool air will be drawn into the lower plenum chamber and will rise as it becomes heated. The air will become gradually warmer and will continue to rise and come into contact with the bulkhead 38. If the blower is not operating, a part of the heated air will be discharged from the lower chamber 41 at the level of bulkhead 38. Also, air will be drawn into the upper chamber 40 at the bulkhead level and will be progressively heated and discharged at the highest point of the opening 36. This natural convection occurs without use of the blower means and has proven through experimentation to be relatively effective.

Natural convection of air also partially occurs between the chambers 40, 41 via the duct means 45, regardless of blower operation. The intake duct section 50 enables passage of the heated air through that duct and the blower and finally through the discharge duct 52 into the upper plenum chamber 41. Here the air is heated even further due to the close proximity of the top surface 13 with the fire. Therefore, the air will continue to rise as it is heated along the upright back wall 21 and over the top surface 13 until it is finally discharged along the upper portions of opening 36 in the upper plenum 40. Of course this natural convection is greatly assisted by operation of the blower means 44.

The blower means 44 functions to speed up the natural convection flow of air through the unit and will therefore increase the efficiency of heat exchange from the firebox to the passing air by forcing a larger volume of air across the heated surfaces. A thermostat 47 and rheostat 48 may be provided as means for effectively controlling the blower means 44 in response to heat variations within the firebox. The thermostat 47 may be connected directly to the firebox and be provided with a standard form of sensor and electrical relay network (not shown) that will actuate the blower means when the temperature within the firebox reaches a prescribed level, for example 100° F. and deactivate the blower means when the temperature drops below a prescribed level, for example 90° F. The rheostat means 48 is supplied primarily for the use of the owner who may wish to regulate the amount of air flowing through the unit for purposes of comfort within the room containing the heater.

Intensity of the fire within the firebox 12 may be selectively controlled through the damper plate 46 and also through provision of a draft means. A variable opening is provided by the draft means into the firebox 12 to allow passage of a selected volume of air for supporting combustion within the firebox. The draft means may include a plate 57, mounted by a hinge 59 to the upright front wall 20 for this purpose. The plate 57 may be selectively set by an adjustment mechanism 58 to cover the opening of the draft means and regulate air flow into the fire chamber. The draft may be closed off entirely so the heater will function with little oxygen to support combustion, allowing the material therein to burn slowly and produce relatively low heat over an extended period of time. Also, when the draft plate 57 is opened, combustion air may flow relatively freely into the firebox to support a more lively, hotter flame.

Prior to operation, the unit is installed with the flue 39 connected to an appropriate chimney (not shown) leading to the exterior of the associated building. The blower is then connected to a power source and the heater is ready for operation. Firstly, the door 24 is opened and a combustible material is placed within the firebox 12. The plate 57 is moved to an open position. The fire is then started and allowed to build until the material is in a state of continuous combustion. Then, if a lower temperature fire is desired, the plate 57 may be moved toward a closed condition to allow a lesser volume of air to pass into the firebox for supporting combustion therein. Of course, the regulation of combustion air through the draft means 56 is correctly accomplished with the door 24 in the closed, latched condition as shown in FIG. 1.

The fire will quickly heat adjacent surfaces of the firebox 12 to a relatively high temperature. The surface temperature will quickly reach a selected level where the thermostat means 47 will function to actuate the blower means 44. However, even at lower temperatures, natural convection of air will occur through the heater 10 due to the specific arrangement of the bulkhead 38 and the duct means 45. The blower means merely increases the flow of air through the heater to more efficiently perform the heat exchanging function of transferring heat that is applied to the surfaces of the firebox, rib members 42, bulkhead 38 and shell 35 to the air passing through the chambers 40 and 41.

Air initially drawn into the lower plenum chamber 41 is initially heated prior to being received by the blower means 44. Therefore, the air entering the upper plenum chamber 40 is in a preheated state and will continue to be increasingly heated as it is passed over the hotter surfaces defining the upper plenum chamber 40. The thoroughly heated air is then exhausted through the opening 36 associated with the upper plenum chamber 40.

Elevational separation of the intake portion of the opening 36 and the discharge section is significant in that cool air is drawn from the floor level, is heated as it is elevated, and is discharged through an elevated opening that is substantially spaced from the cold air intake. A large loop of circulating air is thereby formed. This is in contrast with existing forms of blower units where separation between cold air return and hot air discharge is negligible. In such situations the heated air is merely recirculated through the cold air return and the associated air circulation loop is confined to the area directly adjacent to the heating unit.

I have found through experimentation with the present heater 10 that an entire house may be heated by a single heater 10 situated in one room and operating to circulate air through the entire building structure.

The "two-pass" feature of the present heater is significant in producing the above described large loop circulation effect. The first pass is when air of a fixed volume is drawn initially across the heated surfaces of the lower plenum chamber 41. Then in the second pass, the same air is forced through the blower means 44 and through the upper plenum chamber 40.

The biconvex shape of the top and bottom surfaces 13 and 14 is functional as well as pleasing in appearance. We have found by watching smoke patterns within the firebox that flames within the confines of the biconvex configuration form a cardioid curve initiated at the burning material. The flames spread gradually outwardly and upwardly, then finally curve in and downwardly to create a turbulence within the firebox prior to discharge of the burned gasses through the flue 39. Therefore, an extremely efficient combustion of the material and gasses within the firebox is accomplished. We have found evidence of efficient combustion from the small amount of ash that remains in the firebox.

The above description has been given by way of example to set forth a preferred form of the invention along with the alternate configuration illustrated in FIG. 3. This description and drawings are not intended in any way to restrict the scope of our invention. Only the following claims are to be taken as such restrictions upon the scope of the invention.

What we claim is:

1. A fireplace and room heater, comprising:

a firebox defined by (a) an arcuate top surface, (b) an arcuate bottom surface joined at opposed end edges to the arcuate top surface, (c) an upright back wall joining rearward side edges of the arcuate top and bottom surfaces, and (d) an upright front wall joining forward side edges of the arcuate top and bottom surfaces;

an access opening formed in the upright front wall;

a door hinged to the upright front wall operable to selectively seal the access opening;

a flue opening openly communicating with the firebox interior;

a partially enclosed shell outwardly spaced from the upright back wall and the top and bottom surfaces and defining a forwardly facing opening surrounding the periphery of the upright front wall;

a transverse solid bulkhead extending between the shell and firebox, dividing the space between the shell and the firebox into an upper and a lower plenum chamber;

blower means having an air intake for drawing air inwardly and an air discharge for forcing air outwardly; and duct means openly connecting the air intake of the blower means to the lower plenum chamber and openly connecting the air discharge to the upper plenum chamber;

whereby air may be drawn through the lower plenum chamber and forced outwardly through the upper plenum chamber through operation of the blower means.

2. The fireplace and room heater as defined by claim 1 wherein the arcuate top and bottom surfaces are rectangular and are biconvex along the forward and rearward side edges thereof.

3. The fireplace and room heater as defined by claim 1 further comprising rib members joining the shell with the top and bottom surfaces and extending from the opening between the surfaces and shell to the upright back wall.

4. The fireplace and room heater as defined by claim 1 wherein said bulkhead comprises:

a solid continuous partition extending about the space between the shell and firebox from a location adjacent the front wall at one side of the firebox to the back wall, across the back wall, and forwardly from the back wall to a location adjacent the front wall at the remaining side of the firebox.

5. The fireplace and room heater as defined by claim 1 wherein the blower means is located rearwardly adjacent the upright back wall and wherein the duct means opens into the upper and lower plenum chambers at locations adjacent the bulkhead to facilitate natural convection of air through the chambers.

6. The fireplace and room heater as defined by claim 5 wherein the bulkhead substantially horizontally bisects the space between the firebox and shell to form the upper and lower plenum chambers with substantially equal volumes.

* * * * *